US009666035B2

(12) United States Patent
Blower et al.

(10) Patent No.: US 9,666,035 B2
(45) Date of Patent: May 30, 2017

(54) SECURITY APPARATUS FOR AN AUTOMATED TELLER MACHINE

(71) Applicant: International Business Machines Corporation, Armonk, NY (US)

(72) Inventors: David R. Blower, Middlesex (GB); Simon J. Forsdyke, Essex (GB); Luke Tombs, Northampton (GB); Paul N. Wragg, Rotherham (GB)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/461,768

(22) Filed: Aug. 18, 2014

(65) Prior Publication Data

US 2015/0068863 A1 Mar. 12, 2015

(30) Foreign Application Priority Data

Sep. 9, 2013 (GB) ..... 1315986.8

(51) Int. Cl.
*G07D 7/00* (2016.01)
*G07G 3/00* (2006.01)
(Continued)

(52) U.S. Cl.
CPC ..... *G07F 19/203* (2013.01); *G07D 11/0018* (2013.01); *G07D 11/0021* (2013.01);
(Continued)

(58) Field of Classification Search
CPC .. G07D 11/0018; G07D 7/00; G07D 11/0021; G07D 11/0036; G07D 11/0042;
(Continued)

(56) References Cited

U.S. PATENT DOCUMENTS 4,578,009 A * 3/1986 Granzow et al. ..... 414/789.9
5,240,368 A * 8/1993 Graef ..... B65H 31/3081 271/12

(Continued)

FOREIGN PATENT DOCUMENTS

CN 1858811 11/2006
CN 101881840 11/2010

(Continued)

OTHER PUBLICATIONS

Money Pass, The Nation's fastest-growing surcharge-free network,'Cash claw' fraud on the rise in London, Nov. 29, 2012, Retrieved from Internet on Nov. 19, 2013, URL: http://www.atmmarketplace.com/article/204495/-Cash-claw-fraud-on-the-rise-in-London, 3 pages.

(Continued)

*Primary Examiner* — Jeffrey Shapiro
(74) *Attorney, Agent, or Firm* — Schmeiser, Olsen & Watts, LLP; John Pivnichny

(57) ABSTRACT

A method and associated security apparatus for providing security to an automatic teller machine (ATM) having a cash capture device in a presenter area of the ATM. The cash capture device is detected by a proximity detector in the security apparatus in the ATM. A detecting signal is generated by the proximity detector in response to the cash capture device being detected. The detecting signal is received by control circuitry in the security apparatus and in response, the control circuitry causes a dispensing shutter of the ATM to remain in an open position. Each proximity detector is electrically connected to the control circuitry. The dispensing shutter in the open position is configured, in an absence of the cash capture device in the ATM, to dispense paper currency processed and stored in the presenter area of
(Continued)

the ATM. security apparatus includes the proximity detector and the control circuitry.

17 Claims, 10 Drawing Sheets

(51) Int. Cl.
*G07F 19/00* (2006.01)
*G07D 11/00* (2006.01)
*G07F 1/04* (2006.01)

(52) U.S. Cl.
CPC ..... *G07D 11/0036* (2013.01); *G07D 11/0042* (2013.01); *G07D 11/0048* (2013.01); *G07D 11/0063* (2013.01); *G07F 1/044* (2013.01); *G07F 19/209* (2013.01)

(58) Field of Classification Search
CPC .. G07D 11/0048; G07D 11/0063; G07F 1/02; G07F 9/06; G07F 1/00; G07F 19/203; G07F 19/209
USPC ..... 194/206, 207, 200, 344, 350, 351; 209/534; 235/379; 382/135; 901/8–17
See application file for complete search history.

(56) References Cited

U.S. PATENT DOCUMENTS

| | | | | |
|---|---|---|---|---|
| 6,315,194 | B1 | 11/2001 | Graef et al. | |
| 6,390,367 | B1 * | 5/2002 | Doig | G07F 19/20 235/379 |
| 6,536,662 | B1 * | 3/2003 | Ohno | G07F 19/201 235/379 |
| 7,284,692 | B1 | 10/2007 | Douglass | |
| 7,344,065 | B1 | 3/2008 | Graef | |
| 7,357,304 | B2 * | 4/2008 | Sommerville | G06Q 20/1085 109/19 |
| 7,523,857 | B1 * | 4/2009 | Graef | G06Q 20/042 235/379 |
| 7,780,083 | B2 | 8/2010 | Schliebe et al. | |
| 2005/0173659 | A1 * | 8/2005 | Jespersen | G07D 11/0048 250/559.4 |
| 2005/0269345 | A1 * | 12/2005 | Sommerville | G06Q 20/1085 221/162 |
| 2008/0136657 | A1 * | 6/2008 | Clark | G07F 19/207 340/686.6 |
| 2008/0142583 | A1 * | 6/2008 | Yokoi et al. | 235/379 |
| 2009/0160127 | A1 * | 6/2009 | Kong et al. | 271/264 |
| 2012/0160860 | A1 * | 6/2012 | Milne | B65H 31/3063 221/1 |
| 2012/0280034 | A1 * | 11/2012 | Cha et al. | 235/379 |
| 2014/0151450 | A1 * | 6/2014 | Lewis | G07F 19/209 235/379 |
| 2015/0136562 | A1 * | 5/2015 | Fujita | G07D 11/0018 194/206 |

FOREIGN PATENT DOCUMENTS

| | | |
|---|---|---|
| CN | 102842014 | 12/2012 |
| DE | 102009003685 | 9/2010 |
| EP | 0965960 | 12/1999 |
| EP | 2648168 | 9/2013 |
| GB | 2414104 | 3/2006 |
| JP | 92006313398 | 11/2006 |

OTHER PUBLICATIONS

CENNOX, The ASD-8 Anti-Skimming Device & Trial Proposal, Mar. 7, 2013, www.cennox.com, 7 pages.
Emma Reynolds, Mail Online, Beware the cash trap! Claw-like devices inserted into ATM slots can steal notes in latest hole-in-the-wall scam, Retrieved from internet on Nov. 19, 2013, 6 pages.
International Search Report—PCT (Oct. 22, 2014), Applicant's file Reference Gb130082, International Application No. PCT/IB2014/060429, 10 pages.

* cited by examiner

Prior Art

Prior Art

Prior Art

Prior Art

Prior Art

Prior Art

SECURITY APPARATUS FOR AN AUTOMATED TELLER MACHINE

TECHNICAL FIELD

The invention relates to the field of automated teller machines and in particular a security apparatus for the detection and nullifying of the operation of a cash capture device inserted into a presenter area of an automated teller machine.

BACKGROUND

Automated banking machines are well known. A common type of automated banking machine used by consumers is an automated teller machine ("ATM"), colloquially known by terms such as "cash dispenser", "cash machine" or "hole-in-the-wall". ATMs enable customers to carry out banking transactions. Common banking transactions that may be carried out with ATMs include the dispensing of cash in the form of paper currency, the receipt of deposits, the transfer of funds between accounts, the payment of bills, account balance inquiries and mobile phone top-up etc. The types of banking transactions a customer can carry out are determined by capabilities of the particular banking machine and the institution offering the service.

In the United Kingdom there are around seventy thousand ATMs and this number is on the increase. ATM fraud is also on the increase and perpetrators are constantly devising new ways in which to fraudulently extract cash from inside ATMs. One method in which perpetrators attempt to extract cash from an ATM is by using a cash capture device. A cash capture device is one in which a perpetrator inserts a fraudulent device in to a cash dispensing slot such that the cash is retained inside the ATM and not dispensed to a user who has requested the cash. The perpetrator then returns to the ATM to remove the cash that is retained inside the ATM.

US 2005/0269345 discloses a security means comprising a spray tray; a dispenser slot positioned so as to dispense media into the spray tray; and a security cover positioned to cover said spray tray and slot. The cover is arranged so as to cause a sweep member to sweep past the dispenser slot and thus dislodge any foreign body adjacent the slot, when the cover is moved between closed and opened position. However, this approach does not provide a solution to detect a cash capture device, such as a cash claw being inserted through the cash dispenser into a presenter area of the ATM.

US 2008/0136657 discloses an ATM comprising a fascia having a cash dispensing aperture, a sensor arranged to detect the present of an object outside of the aperture and the distance to the object and a processor. The processor is arranged to determine from the output of the detector whether the distance to the object is within a predetermined maximum and whether the object is moving or stationary and then outputs a signal based on the detection. The purpose of this disclosure is to detect a dummy fascia and once detected an alarm is generated and the ATM taken off line.

ATM fraud appears to be on the increase because it produces cash and is fairly low risk relative to other crimes. The equipment used is inexpensive, readily available and expendable—which makes ATM fraud popular with organized crime networks. Hence there is a need in the art to provide an improved apparatus for cash capture device detection.

BRIEF SUMMARY

The present invention provides a security apparatus, comprising:

at least one proximity detector for detecting a cash capture device in a presenter area of an automatic teller machine (ATM) and for generating a detecting signal in response to the cash capture device being detected; and control circuitry for receiving the detecting signal from the at least one proximity detector and, in response to receiving the detecting signal, for causing a dispensing shutter of the ATM to remain in an open position, wherein each proximity detector is electrically connected to the control circuitry, and wherein the dispensing shutter in the open position is configured, in an absence of the cash capture device in the ATM, to dispense paper currency processed and stored in the presenter area of the ATM.

The present invention provides a machine comprising the ATM which comprises the security apparatus.

The present invention provides a method for providing security to an automatic teller machine (ATM) having a cash capture device in a presenter area of the ATM, said method comprising:

detecting, by a proximity detector of at least one proximity detector in a security apparatus in the ATM, the cash capture device in the presenter area of the ATM and generating, by the proximity detector, a detecting signal in response to the cash capture device being detected; and receiving, by control circuitry in the security apparatus from the proximity detector, the detecting signal and in response causing, by the control circuitry, a dispensing shutter of the ATM to remain in an open position, wherein each proximity detector is electrically connected to the control circuitry, and wherein the dispensing shutter in the open position is configured, in an absence of the cash capture device in the ATM, to dispense paper currency processed and stored in the presenter area of the ATM.

The present invention provides a computer program product, comprising a computer readable storage medium in a security apparatus in an automatic teller machine (ATM), said storage medium having computer readable program code stored therein, said program code containing instructions which, upon being executed by one or more processors in the security apparatus, implement a method for providing security to the ATM, wherein the ATM comprises a cash capture device in a presenter area of the ATM, said method comprising:

detecting, by a proximity detector of at least one proximity detector in the security apparatus via execution of the one or more processors, the cash capture device in the presenter area and generating, by the proximity detector via execution of the one or more processors, a detecting signal in response to the cash capture device being detected; and receiving, by control circuitry in the security apparatus from the proximity detector via execution of the one or more processors, the detecting signal and in response causing, by the control circuitry via execution of the one or more processors, a dispensing shutter of the ATM to remain in an open position, wherein each proximity detector is electrically connected to the control circuitry, and wherein the dispensing shutter in the open position is configured, in an absence of the cash capture device in the ATM, to dispense paper currency processed and stored in the presenter area of the ATM.

DETAILED DESCRIPTION

Figure 1:
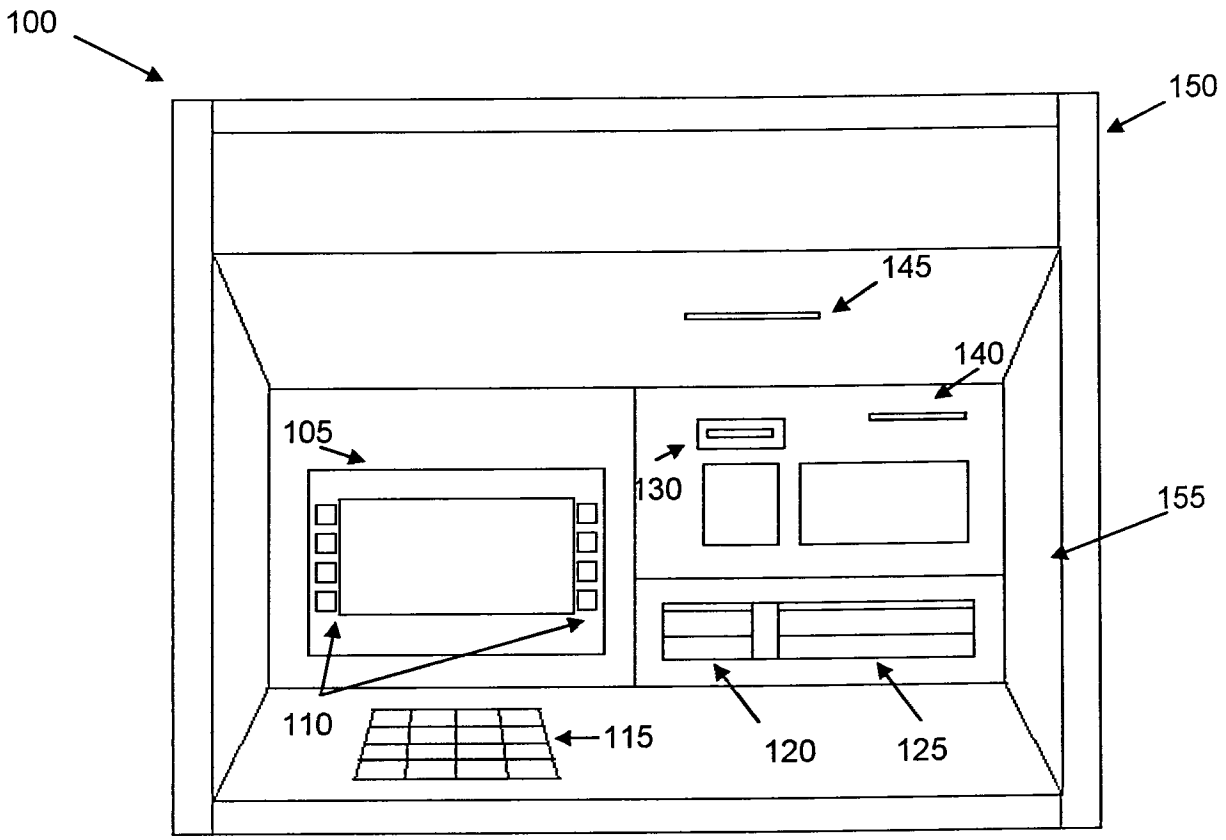
FIG. 1 is an illustration of an outer public face of an automated teller machine as is known in the art.

Accordingly, viewed from a first aspect the present invention provides a security apparatus for detecting the presence of a cash capture device inserted into a paper currency presenting area of an automated teller machine (ATM). The security apparatus comprises: a proximity detector for detecting the insertion of the cash capture device in the paper currency presenting area and generating a detecting signal in response to the cash capture device being detected; and control circuitry for receiving the detecting signal and disabling an operating motor of a paper currency dispensing shutter of the automated teller machine in response to receiving the detecting signal and causing the dispensing shutter to remain in an open position.

The proximity detector may comprise one or more proximity sensors.

The security apparatus may further comprise the control circuitry identifying the absence of any detecting signal from the one or more proximity detectors and in response the control circuitry causing the dispensing shutter to close.

The security apparatus may further comprise the control circuitry identifying the presence of a signal from the one or more proximity detectors and in response the control circuitry causing an ATM operating motor to be disabled.

The security apparatus may further comprise a power restoration delay timer for delaying the dispensing shutter closing for a configurable time period.

The security apparatus may further comprise the control circuitry identifying the absence of any detecting signal from the one or more proximity detectors and in response the control circuitry causing the restoration of power to the operating motor.

The security apparatus may further comprise a power restoration delay timer for delaying the restoration of power to the operating motor for a configurable time period.

The proximity detector may comprise a proximity detector assembly comprising one or more proximity detector sensors and an indicator light for indicating the presence of the detected object.

The proximity detector may be locatable at a position adjacent to a presenter belt of the presenter area of the ATM.

According to a second aspect of the invention, there is provided an ATM comprising the security apparatus of the first aspect.

According to a third aspect of the invention, there is provided a method of detecting the presence of a cash capture device in a presenter area of an ATM. The method comprises: detecting, by a proximity detector, the insertion of the cash capture device in the paper currency presenting area and generating a detecting signal in response to the cash capture device being detected; and receiving, by control circuitry, the detecting signal and disabling an operating motor of a paper currency dispensing shutter of the ATM in response to receiving the detecting signal and causing the dispenser shutter to remain in an open position.

According to a fourth aspect of the invention, there is provided a computer program product comprising a computer readable storage medium storing computer readable program code that, when loaded into a computer system and executed thereon, cause said computer system to perform all the steps of a method according the third aspect.

Advantageously, the present invention provides a means by which a cash dispensing shutter of an ATM remains open when a cash capture device has been inserted into an ATM. Advantageously, the perpetrator is led to believe that the ATM is not working and withdraws the cash capture device from the ATM without damaging the ATM.

Some financial institutions have a presenter clear cycle run prior to a dispense operation. If a presenter clear cycle takes place when a cash claw is inserted into the ATM, the cash claw causes serious damage to the presenter area. To avoid this damage taking place, the present invention provides a means by which the main operating motor is disabled in the presence of a cash capture device thus preventing the clear operation. This disabling function also prevents the clearing operation taking place if the safe door is opened by bank staff.

It is assumed that the perpetrators will immediately remove the cash claw when they realize that the dispenser shutter has not closed. If the perpetrator does not remove the cash claw then on the subsequent cash transaction attempt, the ATM will go out of service and the bank's intervention will be required to restore the ATM to its operating state once the cash capture device has been removed. If the cash capture device is removed immediately following non-closure of the shutter, the dispenser will recover on the subsequent cash withdrawal.

The present invention also provides a function whereby a delay may be introduced to the restoration of the ATM to an operating state, advantageously preventing a fraudster from immediately attempting another cash claw insertion operation.

Advantageously, use of the present invention has the following advantages:

- It prevents fraudulent transactions using a metal cash claw.
- It is simple to upgrade.
- It is easily reversible to aid dispenser servicing.
- It has an integrated 'Metal Detected' LED to aid dispenser servicing.
- No additional software is required.
- It accommodates a variety of Banking Institutions application software.
- It is easily modified to suit differing application software.
- It stays one step ahead of the perpetrator by future-proofing via detectors on all belts.

Figure 2:
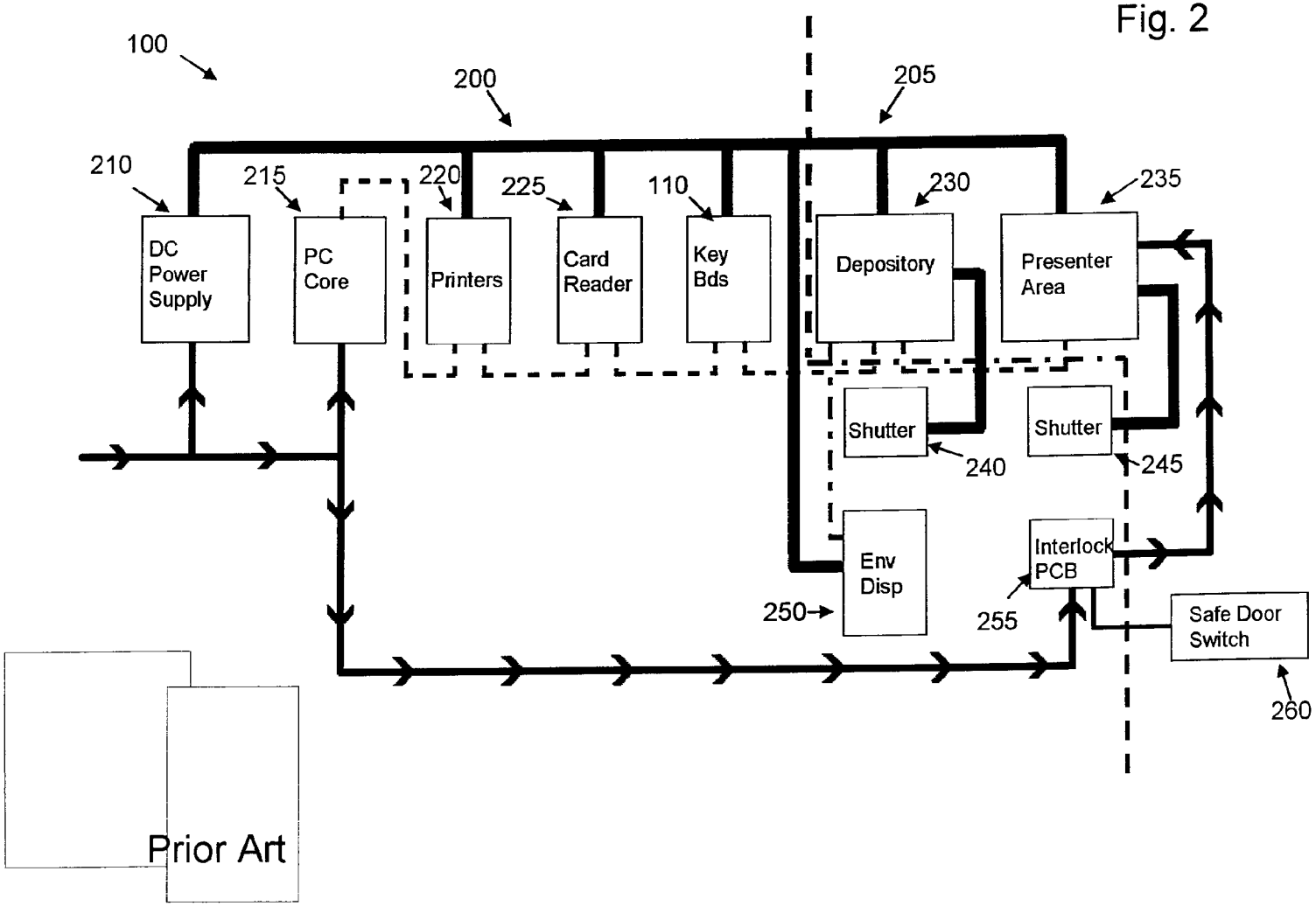
FIG. 2 is a block diagram illustrating an example of the internal components of a typical automated teller machine as is known in the art.

FIG. 1 and FIG. 2 (which should be read in conjunction with each other) illustrate a known automated teller machine (ATM) 100. The ATM 100 comprises a housing 150 which comprises a non-secure portion 200 and a secure portion 205. The non-secure portion 200 comprises a further housing having a public outer fascia 155 which comprises a display 105 for displaying user information to a user, screen selection keys 110 and keypad 115 for inputting data, a card reader 225 for receiving a user bank card or other form of identity via a card receiving aperture 130, a cash dispensing aperture 125 and associated shutter assembly 245 for dispensing cash in the form of paper currency processed and stored in a presenter area 235 of the ATM 100, a deposit aperture 120 for receiving deposits stored in a depository 230 and communicating with a deposit shutter assembly 240, an envelope dispensing aperture 145 for dispensing from envelope dispenser 250 envelopes for holding cash or cheque deposits for receiving by the deposit aperture 120, a receipt dispensing aperture 140 for dispensing receipts acknowledging a transaction made by a customer and a printer 220 for printing the receipts. The non-secure portion 200 also houses a data processing apparatus 215 for communicating with each of the components of the ATM 100 in order to process a requested transaction and to control the mechanical components of the ATM 100 in order to complete a requested and authorized transaction.

The ATM 100 also includes a DC power supply 210, an interlock printed circuit board (PCB) 255, and a safe door switch 260.

Figure 3:
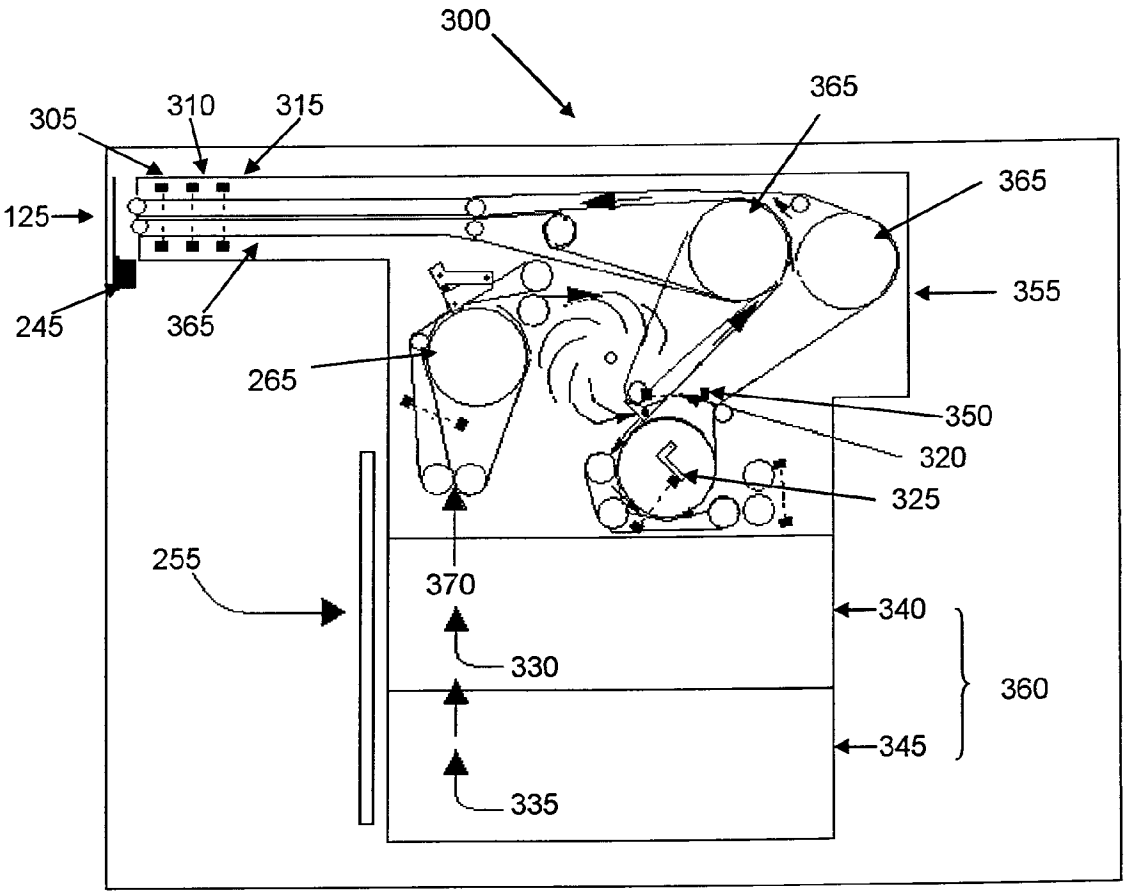
FIG. 3 is a schematic diagram illustrating a side view cross section of an example of an automated teller machine as is known in the art.

FIG. 3 illustrates the secure portion of FIG. 2 in further detail. The secure portion comprises a safe 300. The safe 300 comprises a housing having a first portion comprising a number of slideably mountable racks for mounting currency cassettes 340, 345 (collectively, currency cassettes 360) for storing paper currency. Paper currency is intended herein to mean UK banknotes, U.S.A dollar bills etc. A second portion comprising one or more slideably mountable racks for mounting one or more presenter units 355 comprising pick up modules 265 for singly picking-up one or more paper currency until the requested paper currency nomination is reached. A presenter unit 355 also comprises presenter belts 365 for transporting the requested paper currency from the currency cassettes 340, 345 along a transportation path 330, 335, 370 to the dispenser aperture 125. The second portion further comprises a slideably mountable reject tray (not shown) for holding reject paper currency detected by the data processing apparatus 215. FIG. 3 also includes stack sensors 320 and purge sensor 325.

Presenter area further comprises a number of optical sensors 305, 310, 315 for detecting and validating the presence of paper currency in the presenter area.

For clarity, the presenter area 235 referred to herein comprises one or more presenter units 355, the dispenser shutter assembly 245 and cash dispenser aperture 125. A person skilled in the art will realise that there are many types of internal configurations of an ATM 100 and the above description is not limiting. Many other configurations are possible without departing from the scope of the present invention.

In use a user inserts their bank card into the card reader 130 and the display unit 105 requests the user to enter their personal identification number. The data processing apparatus 215 validates the personal identification number and the display unit 105 presents the user with a number of financial transaction options. When a request for cash withdrawal is made and approved, the data processing apparatus 215 sends an instruction to the pickup module 265 which causes the pickup module 265 to obtain the requested paper currency from one or more of the currency cassettes 340, 345. As the individual units of paper currency are requested, the units of paper currency are validated and if validated the presenter belts 365 transport the paper currency through the secure housing along a transportation path 330, 335 (following the direction of the arrows) for dispensing to the user through the cash dispenser aperture 125. Typically, when the paper currency is transported along the transportation path, the paper currency passes under various sensors 350, 315, 310 and 305. The sensors perform various functions such as:

Sensor 350—acknowledges presence of paper currency after the measuring process.

Sensor 315—acknowledges timely arrival of paper currency for dispense.

Sensor 310—acknowledges timing restrictions and initiates a signal for the dispenser shutter to open.

Sensor 305—acknowledges a timing sequence and signals for dispenser shutter to close.

Once the paper currency is transported a predetermined distance from sensor 305 the cash dispenser shutter 245 remains open until the user removes the paper currency from the cash dispenser aperture 125. Once the paper currency is removed by the user the cash dispenser shutter 245 closes.

Figure 4:
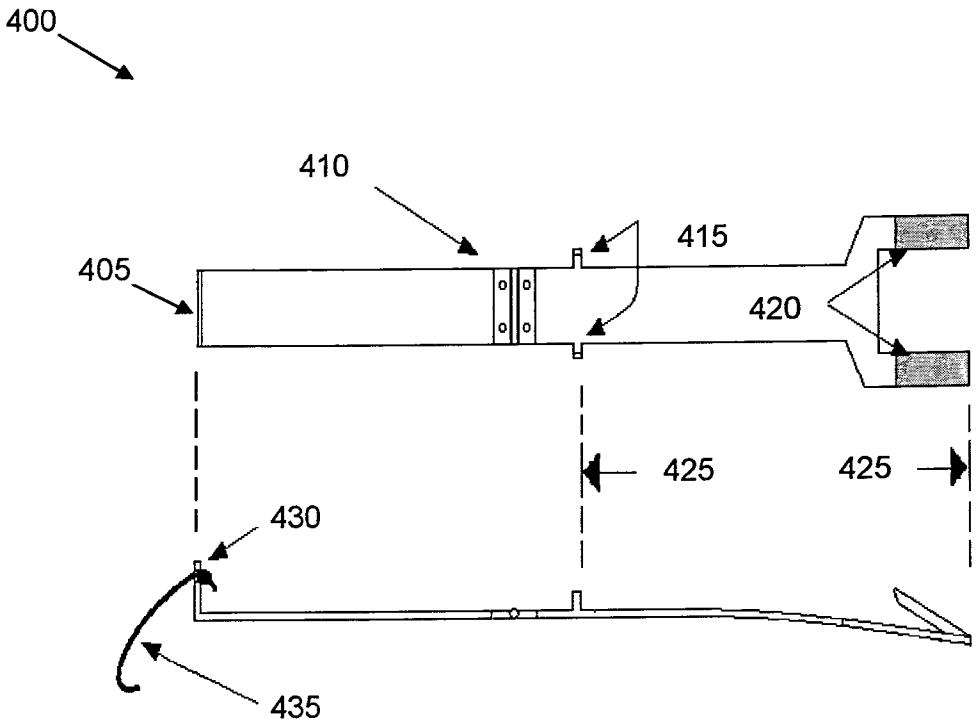
FIG. 4 is an illustration of an example of a cash capture device as is known in the art.

A cash capture device, such as, a cash claw 400 is illustrated in FIG. 4. A cash claw 400 comprises an arm 405 for inserting between one or more presenter belts 365. Optionally, the cash claw 400 may comprise a flexible portion 410 for facilitating manipulation of the cash claw 400 between the presenter belts 365. Optionally also the arm 405 of cash claw 400 may comprise a vertical portion 430 at a proximal end for hindering claw movement during a paper currency dispense operation and a wire 435 for easing removal of claw 400. The flexible portion 410 may comprise a hinge. The cash claw 400 comprises one or more stoppers 415 locatable at a medial point along the length of the arm 405, and having at a distal end one or more claws 420, the one or more claws 420 and one or more stoppers 415 arranged so as to trap the cash between the one or more stoppers 415 and the one or more claws 420 between positions 425. The cash claw 400 is typically manufactured from metal. However a person skilled in the art will realize that the cash claw 400 can be manufactured from any other strong and suitably resilient material.

Figure 5:
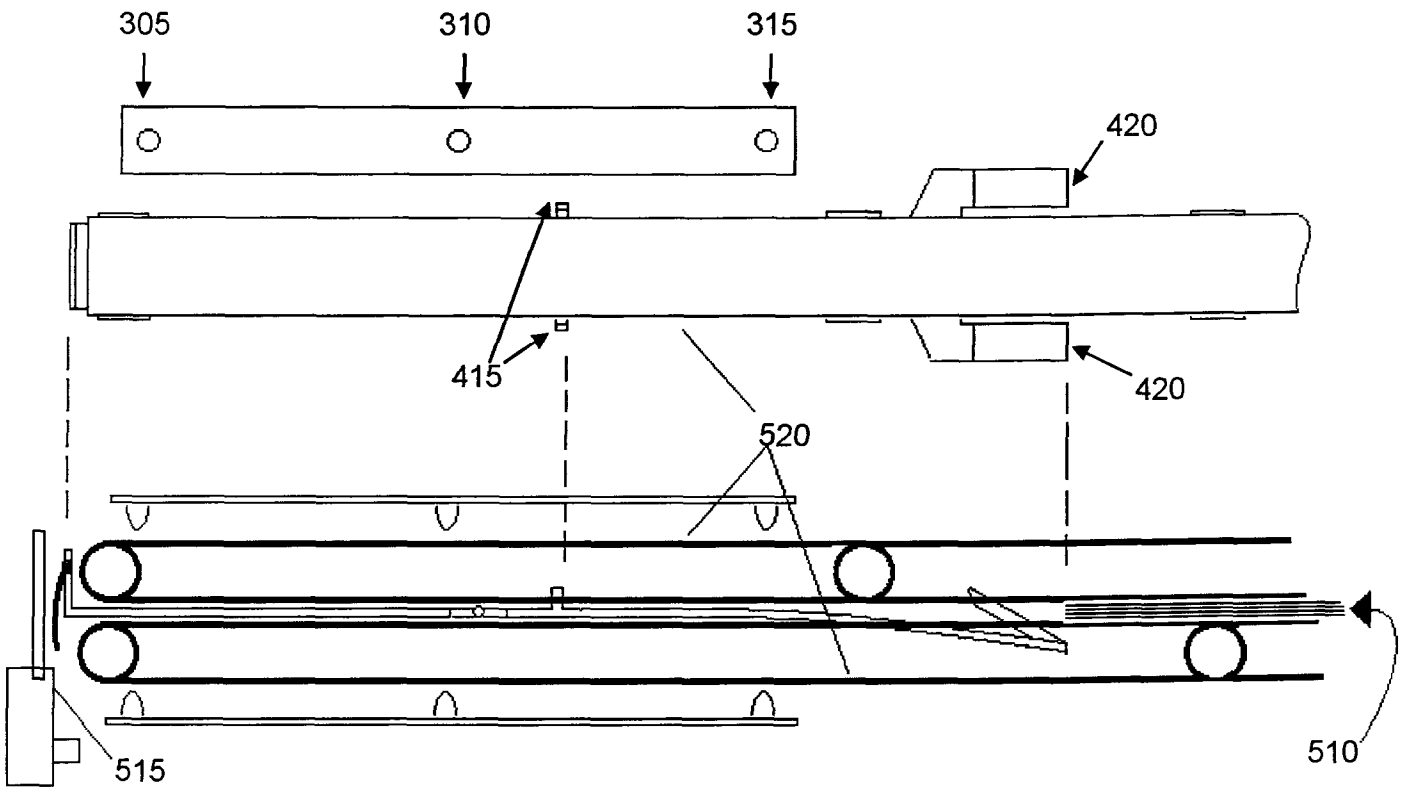
FIG. 5 is an illustration of an example of a cash capture device of FIG. 4 inserted into a presenter area of an ATM as is known in the art.
Figure 6:
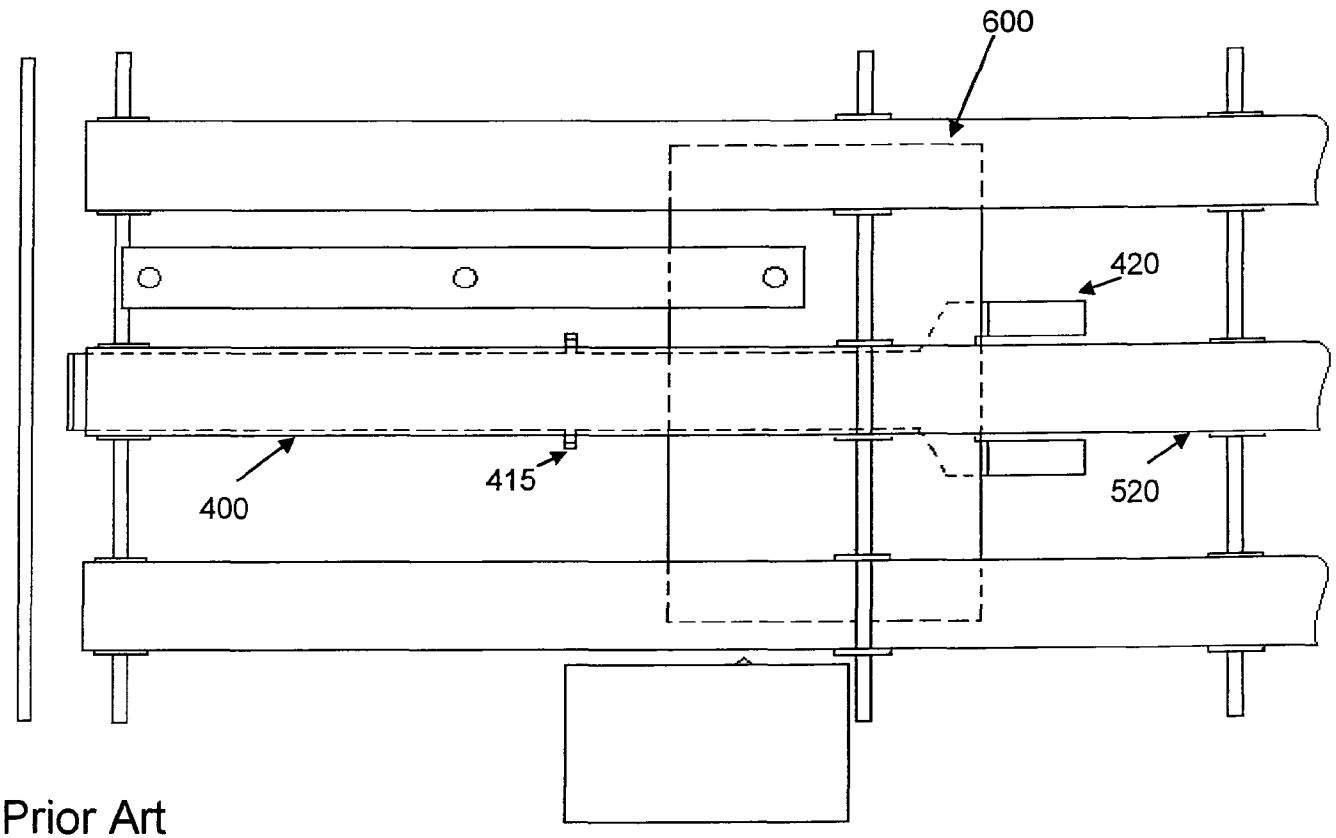
FIG. 6 is an illustration of a bundle of paper currency which has become trapped by the cash capture device of FIG. 4, as is known in the art.

In operation and with reference to FIG. 5 and FIG. 6 the cash claw 400 is inserted through the cash dispensing aperture 125 when the perpetrator withdraws, for example a ten pound paper currency. When the cash dispenser shutter 245 opens and presents the ten pound note the perpetrator slides the cash claw 400 in between the centre presenter belts 520 (for example) and takes the ten pound note. The dispenser shutter 245 then closes and the cash claw 400 sits between the presenter belts 520 in 'stealth mode' awaiting the next cash withdrawal. When the next customer requests a cash withdrawal, the paper currency is retrieved from the currency cassettes 340, 345, but as the paper currency is transported to sensor 315, the paper currency becomes trapped by the cash stoppers 415 and the paper currency does not reach the sensor 310. As a result at this stage in the process a 'jam message' is generated by the data processing apparatus 215 and the presenter area 235 in combination with the data processing apparatus 215 attempts to reverse transportation path, reversing the transportation belts 520, and so to transport the paper currency to a reject bin (not shown). However, this reversal also fails because as the paper currency is transported in a reverse direction the paper currency becomes trapped by the claws 420. FIG. 5 also includes exit shutter 515.

This trapping of paper currency is illustrated with reference to FIG. 6 where reference numeral 600 illustrates the trapped paper currency. The cash dispenser shutter assembly 245 then becomes inoperative and the shutter remains closed. The user whose transaction failed either tries again without success or assumes the ATM 100 is empty of paper currency and leaves the ATM. At this stage the perpetrator returns to the ATM 100, forces the shutter 245 open and pulls the cash claw 400 out of the presenter area 235 accompanied by the previous customer's cash. The ATM is damaged as a result.

In accordance with a preferred embodiment of the invention, the security apparatus will now be explained with reference to FIGS. 7 to 10.

Figure 7:
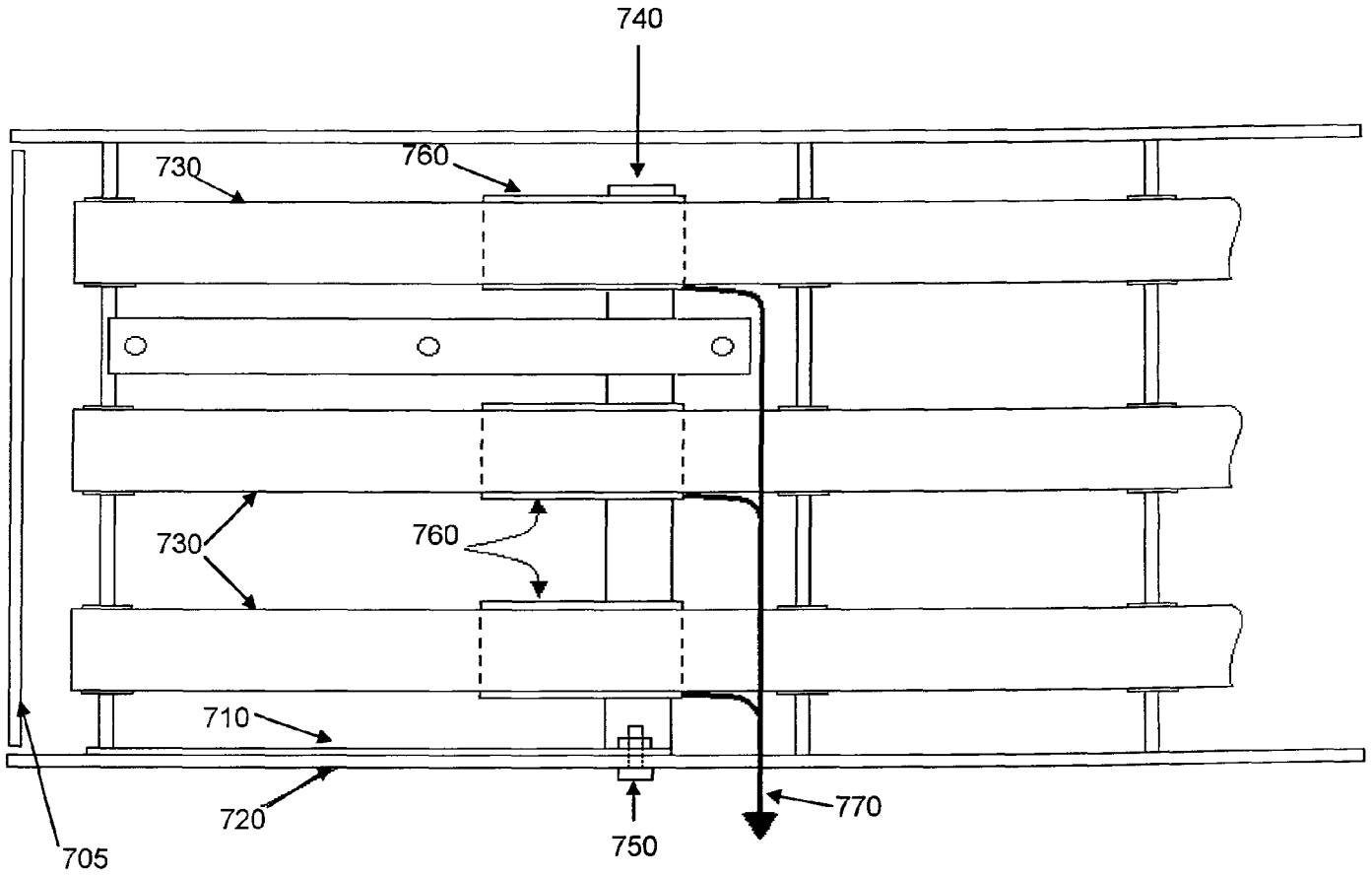
FIGS. 7 and 7*a* are illustrations of a top view of a presenter area of the automated teller machine with a security apparatus of the present invention installed.
Figure 7A:
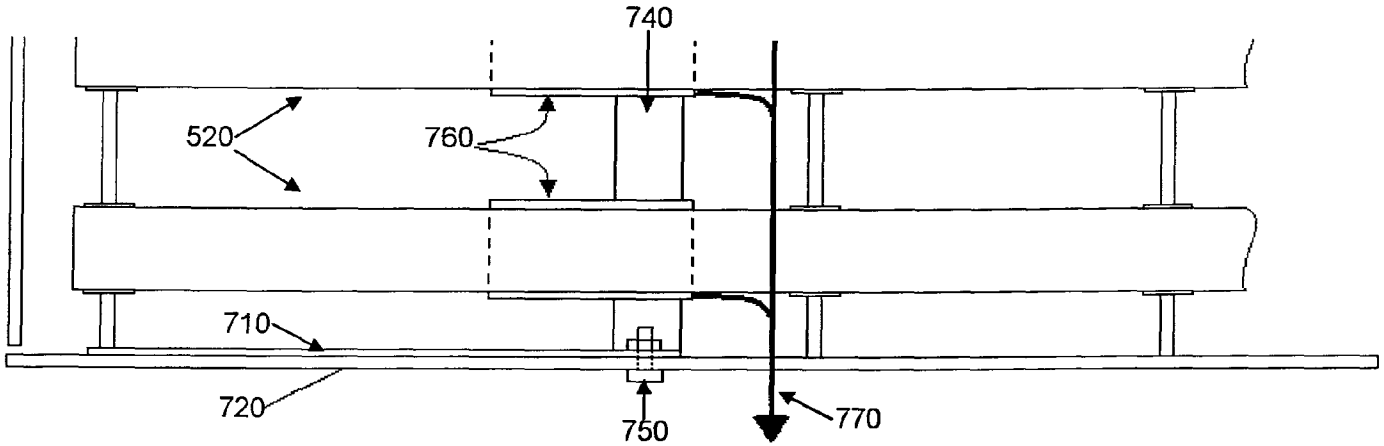

FIG. 7 (a portion of which is also shown in FIG. 7*a*) illustrates a plan view as viewed from above the lower belt level of the paper currency presenting area, or presenter area, adjacent to the cash dispensing aperture 125 and cash dispensing shutter 705 according to an embodiment of the present invention. In the illustrated embodiment, three belts are shown across the width of the presenter area. The skilled person will understand that other arrangements comprising higher or lower numbers of belts are possible without departing from the scope of the present invention. Side member 710 comprises a substantially rigid strip attached to presenter belt support frame 720 at approximately the same vertical level as the lower presenter belts 730. Cross member 740 comprises a substantially rigid beam. In an embodiment side member 710 and cross member 740 are manufactured from a suitable metal or metal alloy. A person skilled in the art will realize that any suitable material may be used.

Cross member 740 is attached to side member 710 using any suitable attachment means. In the illustrated example embodiment, attachment means comprises nut and bolt fastening 750 but a skilled person will understand that attachment means may comprise other fastener device such as a riveted joint, or a welded joint, an adhesive joint, or any other suitable attachment means. Further, in the illustrated embodiment, attachment means also functions to attach side member 710 to presenter belt support frame 720. The skilled person will also understand that separate attachment means of any suitable type may also be used without departing from the scope of the invention.

As illustrated, cross member 740 is attached to side member 710 towards the end furthest from the cash dispenser shutter 705 but the skilled person will understand that cross member may 740 be attached at any suitable point without departing from the scope of the invention. Cross member 740 projects substantially at right angles to side member 710. In an embodiment, cross member 740 projects across substantially the whole width of the presenter belts 730. Further, cross member 740 projects between the upper and lower portions of the lower presenter belts 730 and spaced from each portion so that it does not contact either upper or lower portion of the belts.

In an embodiment, at least one proximity detector comprising proximity detector sensor assembly 760 is attached to cross member 740. Each proximity detector sensor assembly 760 may comprise at least one sensor suitable for the identification of a nearby metallic object. It will be understood by the skilled person, however, that any suitable proximity detector sensor may be used. In some embodiments, a sensor capable of detecting a non-metallic object may be used. In some embodiments, more than one sensor may be used in an assembly, and sensors of different types may be used together in a single proximity detector sensor assembly, or in different assemblies. Proximity detector sensors of several different types are well known in the art.

Each proximity detector sensor assembly 760 is attached at a point on the cross member 740 substantially adjacent a presenter belt 730. Further, each proximity detector sensor assembly 760 is attached to cross member 740 in such a way as to be between the under surface of the upper portion of a presenter belt 730 and the top of the lower portion of the presenter belt 730. Each proximity detector sensor assembly 760 is mounted so as to not inhibit motion of its lower presenter belt but to be close enough to the under surface of the upper portion of the lower presenter belt so as to detect objects above the top surface of the belt.

In an embodiment, at least one proximity detector sensor assembly 760 is mounted beneath the under surface of the upper portion of each presenter belt 730. It will be apparent to the person skilled in the art that other arrangements are possible without departing from the scope of the present invention. In one embodiment, proximity detector sensor assembly 760 is mounted beneath the under surface of the upper portion of the central presenter belt 730 only. In another embodiment, proximity detector sensor assemblies 760 are mounted beneath the under surface of the upper portion of each outer presenter belt 730 only. In a further embodiment, cross member 740 projects only part way through presenter belts 730, for example only as far as the central belt of the three illustrated in the embodiment. In yet a further embodiment, a proximity detector assembly 760 is mounted at a position along cross member 740 which is not directly below the upper portion of a lower presenter belt 730.

Each proximity detector sensor 760 is electrically connected by electrical connection wiring 770 to proximity detector control circuitry, which will be described later with reference to FIG. 9.

Figure 8:
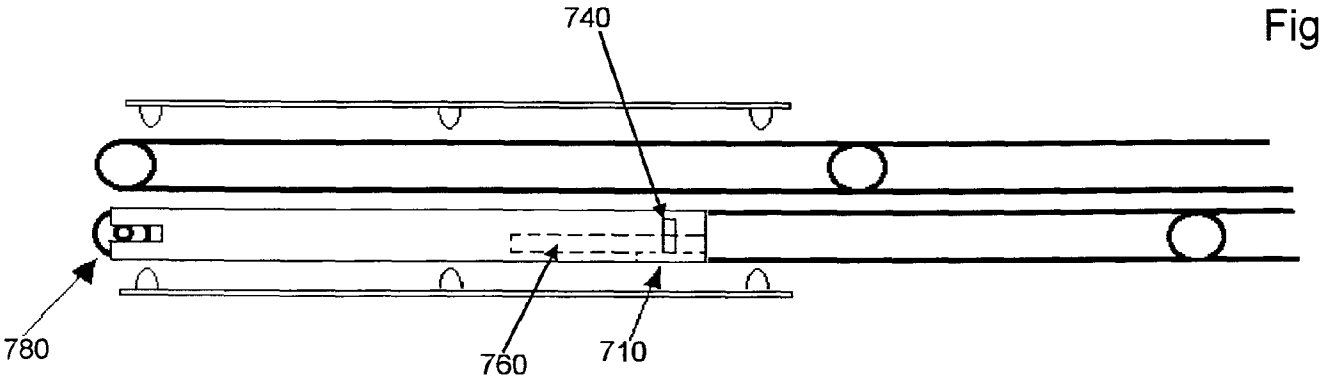
FIG. 8 is an illustration of side view of the presenter area with the security apparatus of the present invention installed.

FIG. 8 illustrates a side view of the presenter area illustrated in FIGS. 7 and 7*a*. Side member 710 is attached to the presenter belt support frame 720 illustrated in FIGS. 7 and 7*a* (not shown in the present figure for clarity). Side member 710 comprises a substantially rigid strip, which may be formed from a metal or metal alloy as previously described, but the skilled person will understand that any other material of sufficient rigidity may be used. Cross member 740 is illustrated attached towards the side member end furthest from the cash dispenser shutter. The skilled person will understand that any other suitable attachment point may be used without departing from the scope of the invention.

Also illustrated is proximity detector sensor assembly 760 orientated approximately parallel to a lower presenter belt 730 and attached to cross member 740. In an embodiment proximity detector sensor assembly 760 may be mounted to cross member 740 in such a way as to be detachable. In another embodiment, proximity detector sensor assembly 760 may be fixed to cross member 740 in such a way as to allow adjustment of its position in relation to lower presenter belt 730. In one embodiment as illustrated, side member 710 terminates at its end closest to the shutter assembly in two finger-like portions 780 extending above and below the axle of the front most pulleys of the lower presenter belts 730.

Figure 9:
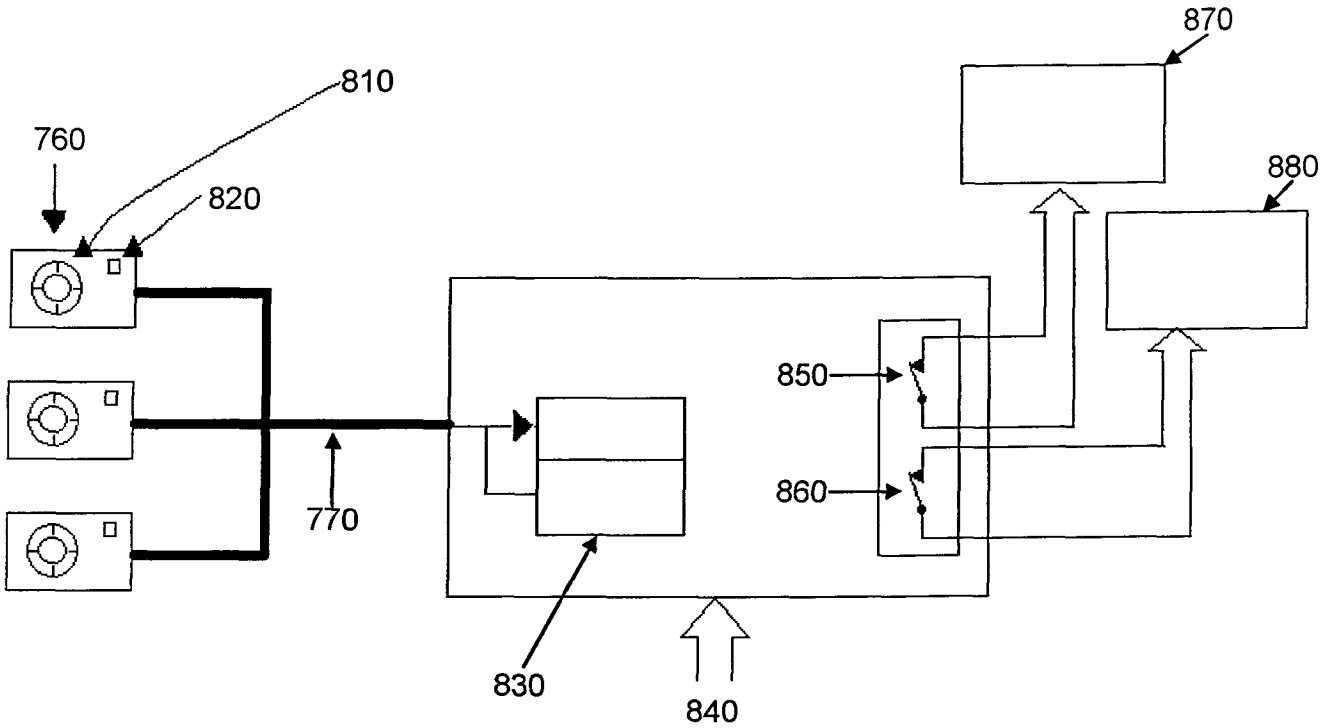
FIG. 9 is a block diagram of the security apparatus in accordance with embodiments of the present invention.

FIG. 9 is a diagrammatic representation of an embodiment of the present invention showing connection of the proximity detector sensor assemblies 760 to the electrical control circuitry. Illustrated is an embodiment in which there are three proximity detector assemblies 760, one for each presenter belt as previously described. In this exemplary embodiment, each proximity detector assembly 760 comprises a single proximity detector sensor 810. Also shown is indicator 820 comprising for example an indicator light, for example a light emitting diode (LED). LED 820 is connected to proximity detector sensor 810 so as to illuminate when the proximity detector sensor 810 detects an object, and then remain illuminated until, for example, removal of the cash capture device or when reset by a maintenance operator. A person skilled in the art will realize that other types of indicators may be used without departing from the scope of the invention.

When an object, for example cash claw 400 as previously illustrated is inserted in to the presenter area of the ATM, as illustrated in FIGS. 5 and 6, the presence of an object nearby, for example within ten millimeters, of proximity detector sensor 810 of proximity detector sensor assembly 760, causes the proximity detector sensor 810 to produce a signal indicative of the detection. For example, in embodiments in which proximity sensor 810 is a metal detector, the proximity detector sensor 810 detects the presence nearby of a metal object. The signal is transmitted to control circuitry 830 mounted in the present embodiment on printed circuit board (PCB) 840. PCB 840 may be mounted in any convenient internal location of the ATM 100. In response, control circuitry 830 sends a first control signal to switching means 850 to activate the switching means 850 to disconnect access to electrical power of the ATM shutter motor 870 and so disable the shutter in the open position. Optionally, control circuitry 830 is also operable to disconnect electrical power from the ATM safety interlock circuit via switching means 860 and so disable the main operating motor 880 of the ATM 100.

Figure 10:
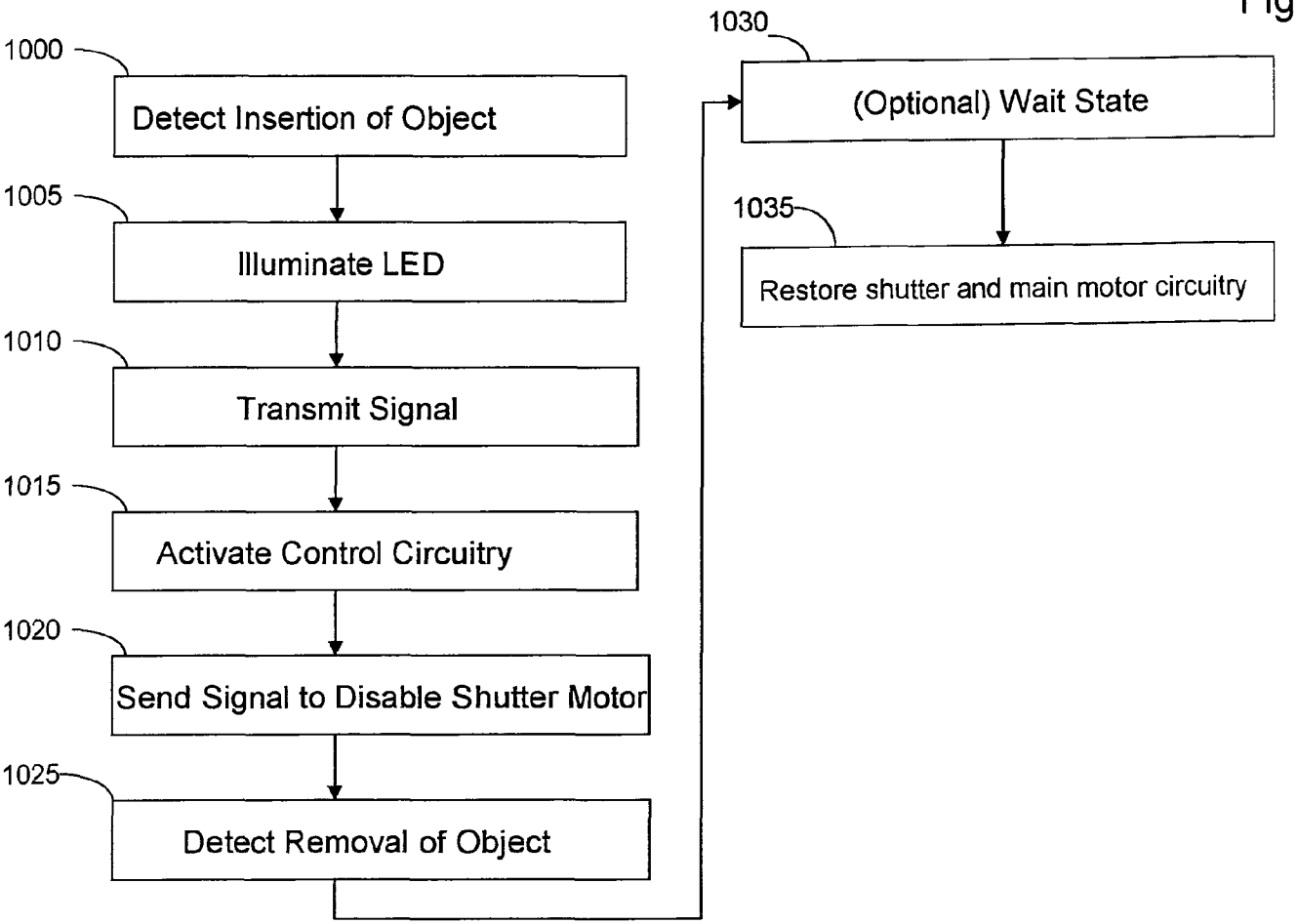
FIG. 10 is a flow diagram illustrating the process steps of the security apparatus in accordance with embodiments of the present invention.

The operation of an embodiment of the invention will now be described in more detail with reference to the flow diagram of FIG. 10. FIG. 10 illustrates the sequence of operations in an embodiment of the invention when a fraudster attempts to use a cash capture device such as cash claw 400 at ATM 100.

At step 1000, an object (e.g., cash claw 400) is detected in the proximity of a presenter belt in the presenter area of the ATM 100 by one or more of the proximity detector assemblies 760. At this point in time the dispenser shutter 245 is open after the perpetrator's transaction.

At step 1005, an LED 820 associated with one of the proximity detector assemblies 760 illuminates. At step 1010, one or all of the proximity detector assembly sensors of the assemblies which are deployed and are in use and which have detected the object 400 transmit, for example, a 24 volt signal to the control circuitry to signal that the dispenser shutter 245 should remain open. At step 1015 a switching means for controlling ATM motors is activated. The switching means may comprise two switching means, a first switching means 850 for operating the dispenser shutter motor 870 and a second switching means 860 for operating the ATM main operating motor 880.

At step 1020, a signal is sent by control circuitry 830 to operate first switching means 850 to disable the dispenser shutter motor 870 such that the shutter remains open when in the presence of an object such as cash claw 400, which causes the perpetrator to believe that the ATM is not working to motivate the perpetrator to withdraw the cash claw 400 from the ATM without damaging the ATM.

Some financial institutions operate a presenter clear cycle run prior to a currency dispense operation which involves operation of presenter belts. If such a presenter clear cycle takes place when an object such as cash claw 400 is present in the presenter area of the ATM, serious damage may be caused. Optionally, therefore, control circuitry 830 also operates second switching means 860 such that it disables ATM main operating motor 880 and operation of the presenter clear cycle is prevented. This disabling function also prevents the clearing operation taking place if the safe door is opened by an ATM operator.

At step 1025 control circuitry 830 detects that there is no longer any detection signal from the one or more proximity detector sensors 810 of assemblies 760 so that there is no longer an indication of an object in the proximity of one or more of the presenter belts, for example, because the perpetrator has removed the object 400 from the presenter area of the ATM.

At step 1035 the absence of a detection signal causes control circuitry 830 send another control signal to activate switching means 850 to reconnect the dispenser shutter motor 870 to electrical power to close the dispensing shutter normally. If previously disconnected, control circuitry 830 also initiates an action for activating switching means such that second switching means 860 reconnects the ATM main operating motor 880 and the ATM may return to normal operation.

In another embodiment, at optional step 1030, the proximity detector control assembly comprises a power restoration delay timer in the control circuitry 830 which commences timing operation when the removal of the object is detected. This provides a "wait state" period during which ATM operation is disabled with the shutter in the open position rather than immediately restoring power to motors, including dispenser shutter motor 870 and main operating motor 880.

The timer may be set for a configurable period of time after which normal operation of the ATM commences as power is restored. In one embodiment, the configurable period of time can be from zero to fifteen minutes. However, a person skilled in the art will realize that other configurable time periods are possible without departing from the scope of the invention.

The present invention provides a security apparatus, comprising: (i) at least one proximity detector for detecting a cash capture device in a presenter area of an automatic teller machine (ATM) and for generating a detecting signal in response to the cash capture device being detected; and (ii) control circuitry for receiving the detecting signal from the at least one proximity detector and, in response to receiving the detecting signal, for causing a dispensing shutter of the ATM to remain in an open position, wherein each proximity detector is electrically connected to the control circuitry, and wherein the dispensing shutter in the open position is configured, in an absence of the cash capture device in the ATM, to dispense paper currency processed and stored in the presenter area of the ATM.

The security apparatus may further comprise: first switching means for receiving from the control circuitry a first control signal that causes the dispensing shutter to remain in the open position via disconnection, by the first switching means, of access to electrical power by a shutter motor configured to open or close the dispensing shutter.

The first switching means may be configured, after the first control signal is received, to receive from the control circuitry another control signal that causes the first switching means to reconnect access to electrical power by the shutter motor to enable the shutter motor to close the dispensing shutter.

The present invention provides a machine comprising the ATM which comprises the security apparatus.

The present invention provides a method, and associated computer program product, for providing security to an automatic teller machine (ATM) having a cash capture device in a presenter area of the ATM, wherein the method comprises: (i) detecting, by a proximity detector of at least one proximity detector in a security apparatus in the ATM, the cash capture device in the presenter area of the ATM and generating, by the proximity detector, a detecting signal in response to the cash capture device being detected; and (ii) receiving, by control circuitry in the security apparatus from the proximity detector, the detecting signal and in response causing, by the control circuitry, a dispensing shutter of the ATM to remain in an open position, wherein each proximity detector is electrically connected to the control circuitry, and wherein the dispensing shutter in the open position is configured, in an absence of the cash capture device in the ATM, to dispense paper currency processed and stored in the presenter area of the ATM.

The method may further comprise: receiving, by first switching means in the security apparatus from the control circuitry, a first control signal that causes the dispensing shutter to remain in the open position via disconnection, by the first switching means, of access to electrical power by a shutter motor configured to open or close the dispensing shutter.

The method may further comprise: after said receiving the first control signal, receiving, by the first switching means from the control circuitry, another control signal that causes the first switching means to reconnect access to electrical power by the shutter motor to enable the shutter motor to close the dispensing shutter.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

A computer program product comprises a computer readable storage medium in a security apparatus in an automatic teller machine (ATM). The storage medium has computer readable program code stored therein. The program code contains instructions which, upon being executed by one or more processors in the security apparatus, implement the methods of the present invention, including a a method for providing security to the ATM, wherein the ATM comprises a cash capture device in a presenter area of the ATM.

It will be clear to one skilled in the art that many improvements and modifications can be made to the foregoing exemplary embodiment without departing from the scope of the present invention.

What is claimed is:

1. A security apparatus, comprising:

a plurality of proximity detectors for detecting a cash capture device in a presenter area of an automatic teller machine (ATM) and for generating a detecting signal in response to the cash capture device being detected, wherein the cash capture device is a fraudulent device inserted into the ATM by a perpetrator and configured to retain cash inside the ATM and prevent the cash from being dispensed to a user who requested the cash;

control circuitry for receiving the detecting signal from the plurality of proximity detectors and, in response to receiving the detecting signal, for disconnecting a shutter motor's access to electrical power, wherein said disconnecting the shutter motor's access to electrical power disables a dispensing shutter of the ATM in an open position and causes the dispensing shutter of the ATM to remain in the open position, wherein each proximity detector is electrically connected to the control circuitry, and wherein the dispensing shutter in the open position is configured, in an absence of the cash capture device in the ATM, to dispense the paper currency processed and stored in the presenter area of the ATM; and a plurality of presenter belts, in the presenter area of the ATM, for transporting the paper currency from currency cassettes along a transportation path to a dispenser aperture, wherein each proximity detector is attached to a cross member that is oriented at a right angle to each presenter belt, wherein the cross member is disposed between, and not in contact with, an upper and lower portion of the each presenter belt, wherein each attached proximity detector is disposed between, and not in contact with, the upper and lower portion of a respective presenter belt of the plurality of presenter belts, and wherein each proximity detector is positioned to not inhibit motion of the respective presenter belt but to be close enough to an under surface of an upper portion of the respective presenter belt so as to detect objects above a top surface of the respective presenter belt.

2. The security apparatus of claim 1, further comprising:

first switching means for receiving from the control circuitry a first control signal that causes the first switching means to disconnect the shutter motor's access to electrical power.

3. The security apparatus of claim 2, further comprising:

a printed circuit board comprising the control circuitry, the first switching means, and an electrical connection between the control circuitry and the first switching means.

4. The security apparatus of claim 2, wherein the first switching means is configured, after the first control signal is received, to receive from the control circuitry another control signal that causes the first switching means to reconnect the access to electrical power by the shutter motor to enable the shutter motor to close the dispensing shutter.

5. The security apparatus of claim 4, further comprising:

a first delay timer for delaying reconnection of access to electrical power by the shutter motor for a first specified time period.

6. The security apparatus of claim 2, further comprising:

second switching means for receiving from the control circuitry a second control signal that disconnects, by the second switching means, access to electrical power by an ATM main operating motor, which prevents a presenter clear cycle from occurring in the ATM.

7. The security apparatus of claim 6, wherein the second switching means is configured, after the second control signal is received, to receive from the control circuitry a different control signal that causes the second switching means to reconnect access to electrical power by the ATM main operating motor.

8. The security apparatus of claim 1, wherein a proximity detector of the plurality of proximity detectors is configured to detect the cash capture device positioned within ten millimeters of the proximity detector.

9. A machine, comprising:

the security apparatus of claim 1; and the ATM, wherein the ATM comprises the security apparatus.

10. A method for providing security to an automatic teller machine (ATM) having a cash capture device in a presenter area of the ATM, said method comprising:

detecting, by a proximity detector of a plurality of proximity detectors in a security apparatus in the ATM, the cash capture device in the presenter area of the ATM and generating, by the proximity detector, a detecting signal in response to the cash capture device being detected, wherein the cash capture device is a fraudulent device inserted into the ATM by a perpetrator and configured to retain cash inside the ATM and prevent the cash from being dispensed to a user who requested the cash;

receiving, by control circuitry in the security apparatus from the proximity detector, the detecting signal and in response disconnecting, by the control circuitry, a shutter motor's access to electrical power, wherein said disconnecting the shutter motor's access to electrical power disables a dispensing shutter of the ATM in an open position and causes the dispensing shutter of the ATM to remain in the open position, wherein each proximity detector is electrically connected to the control circuitry, and wherein the dispensing shutter in the open position is configured, in an absence of the cash capture device in the ATM, to dispense paper currency processed and stored in the presenter area of the ATM; and transporting, via a plurality of presenter belts in the presenter area of the ATM, the paper currency from currency cassettes along a transportation path to a dispenser aperture, wherein each proximity detector is attached to a cross member that is oriented at a right angle to each presenter belt, wherein the cross member is disposed between, and not in contact with, an upper and lower portion of the each presenter belt, wherein each attached proximity detector is disposed between, and not in contact with, the upper and lower portion of a respective presenter belt of the plurality of presenter belts, and wherein each proximity detector is positioned to not inhibit motion of the respective presenter belt but to be close enough to an under surface of an upper portion of the respective presenter belt so as to detect objects above a top surface of the respective presenter belt.

11. The method of claim 10, said method further comprising:

receiving, by first switching means in the security apparatus from the control circuitry, a first control signal that causes the first switching means to disconnect the shutter motor's access to electrical power.

12. The method of claim 11, said method further comprising:

after said receiving the first control signal, receiving, by the first switching means from control circuitry, another control signal that causes the first switching means to reconnect the access to electrical power by the shutter motor to enable the shutter motor to close the dispensing shutter.

13. The method of claim 12, said method further comprising:

delaying, by a first delay timer in the security apparatus, for a first specified time period, reconnection of access to electrical power by the shutter motor.

14. The method of claim 11, said method further comprising:

sending, by the control circuitry to second switching means in the security apparatus, a second control signal in further response to the control circuitry receiving the detecting signal; and receiving, by the second switching means from the control circuitry, the second control signal that activates disconnection, by the second switching means, of access to electrical power by an ATM main operating motor, which prevents a presenter clear cycle from occurring in the ATM.

15. A computer program product, comprising a computer readable storage medium in a security apparatus in an automatic teller machine (ATM), said storage medium having computer readable program code stored therein, said program code containing instructions which, upon being executed by one or more processors in the security apparatus, implement a method for providing security to the ATM, wherein the ATM comprises a cash capture device in a presenter area of the ATM, wherein the cash capture device is a fraudulent device inserted into the ATM by a perpetrator and configured to retain cash inside the ATM and prevent the cash from being dispensed to a user who requested the cash, said method comprising:

detecting, by a proximity detector of a plurality of proximity detectors in the security apparatus via execution of the one or more processors, the cash capture device in the presenter area and generating, by the proximity detector via execution of the one or more processors, a detecting signal in response to the cash capture device being detected; and receiving, by control circuitry in the security apparatus from the proximity detector, the detecting signal and in response disconnecting, by the control circuitry, a shutter motor's access to electrical power, wherein said disconnecting the shutter motor's access to electrical power disables a dispensing shutter of the ATM in an open position and causes the dispensing shutter of the ATM to remain in the open position, wherein each proximity detector is electrically connected to the control circuitry, and wherein the dispensing shutter in the open position is configured, in an absence of the cash capture device in the ATM, to dispense paper currency processed and stored in the presenter area of the ATM;

transporting, via a plurality of presenter belts in the presenter area of the ATM, the paper currency from currency cassettes along a transportation path to a dispenser aperture, wherein each proximity detector is attached to a cross member that is oriented at a right angle to each presenter belt, wherein the cross member is disposed between, and not in contact with, an upper and lower portion of the each presenter belt, wherein each attached proximity detector is disposed between, and not in contact with, the upper and lower portion of a respective presenter belt of the plurality of presenter belts, and wherein each proximity detector is positioned to not inhibit motion of the respective presenter belt but to be close enough to an under surface of an upper portion of the respective presenter belt so as to detect objects above a top surface of the respective presenter belt.

16. The computer program product of claim 15, said method further comprising:

receiving, by first switching means in the security apparatus from the control circuitry via execution of the one or more processors, a first control signal that causes the first switching means to disconnect the shutter motor's access to electrical power.

17. The computer program product of claim 16, said method further comprising:

after said receiving the first control signal, receiving, by the first switching means from the control circuitry via execution of the one or more processors, another control signal that causes the first switching means to reconnect the access to electrical power by the shutter motor to enable the shutter motor to close the dispensing shutter.

* * * * *